United States Patent [19]

Jukola

[11] 4,299,410

[45] Nov. 10, 1981

[54] SOFT-COVER PAPERBACK BOOK AND A METHOD OF MANUFACTURING SUCH A BOOK

[76] Inventor: Eero Jukola, Karjoportintie 20, 42700 Keuruu, Finland

[21] Appl. No.: 72,768

[22] Filed: Sep. 5, 1979

[30] Foreign Application Priority Data

May 11, 1979 [FI] Finland ..... 791516

[51] Int. Cl.[3] ..... B42C 9/00; B42C 11/00

[52] U.S. Cl. ..... 281/21 R; 11/1 AD; 11/4

[58] Field of Search ..... 11/1 R, 1 AD, 4; 281/21 R, 29 R

[56] References Cited

U.S. PATENT DOCUMENTS 4,187,571 2/1980 Asterö11 ..... 1 AD/

FOREIGN PATENT DOCUMENTS 477987 10/1969 Switzerland ..... 11/4

*Primary Examiner*—Paul A. Bell

*Attorney, Agent, or Firm*—Young & Thompson

[57] ABSTRACT

A soft-cover paperback book comprising a block consisting of a plurality of leaves as well as a soft cover fastened to the block. The back of the block is fastened to a flexible, firm support layer over the entire surface of the back and the soft cover is fastened to said block only at the front and rear cover to the first and the last leaf of the block respectively. Thereby the spine portion of the soft cover is loose from the back of the block, so that the spine portion of the soft cover does not resist opening of the block.

10 Claims, 5 Drawing Figures

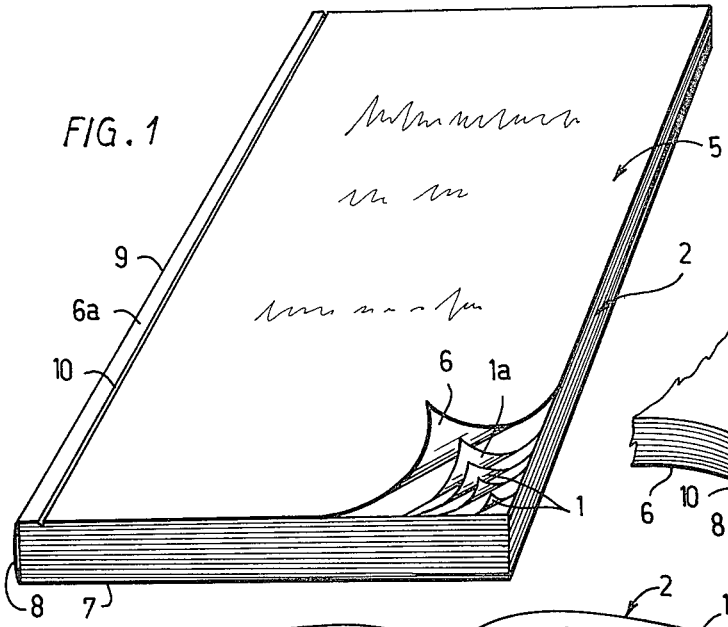
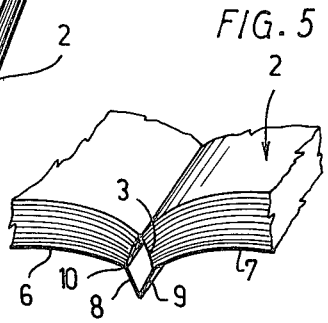
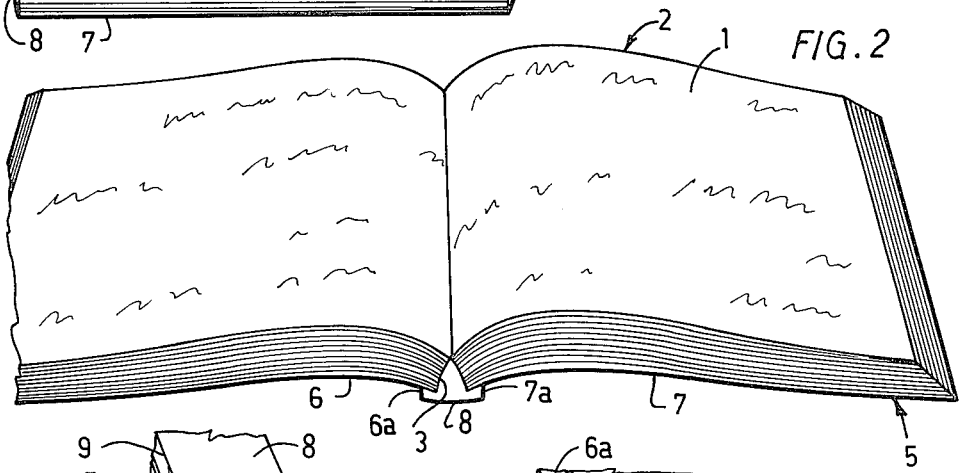
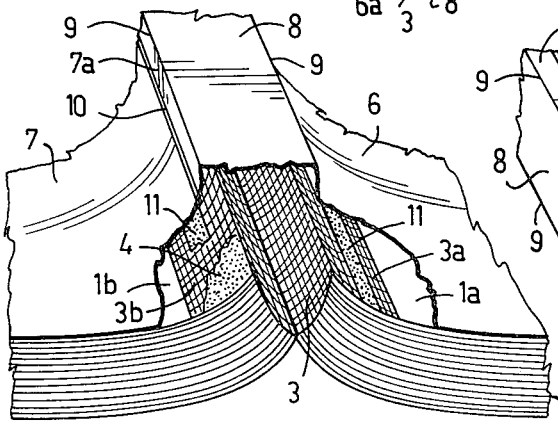
FIG. 3
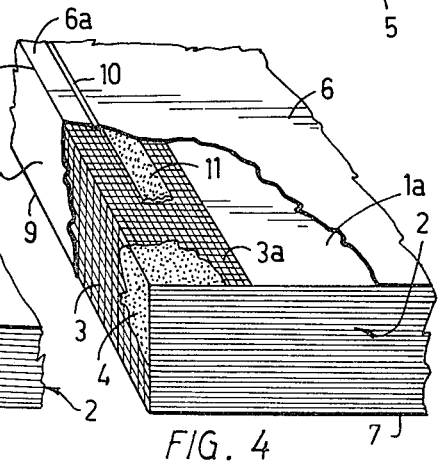
FIG. 4

SOFT-COVER PAPERBACK BOOK AND A METHOD OF MANUFACTURING SUCH A BOOK

The subject of the present invention is a soft-cover paperback book, which comprises a block consisting of leaves joined together at their spine edges as well as a soft cover fastened to said block.

By paperback book is in the present connection meant, besides ordinary books, also various catalogues, form booklets, and similar paperback products.

In the manufacture of paperback, soft-cover books, it is a known procedure to fasten a book block, consisting of leaves bundled, together to a soft cover by glueing said block against the spine of the soft cover over the entire surface of the spine. The spine of the cover thereby functions as the means which joins and keeps the leaves of the book block together. In some cases the soft cover has, in addition to that the entire spine of the cover is glued against the spine of the block, also been glued to the first and the last leaf of the book block along narrow strips positioned adjacent the glued back of the book block so as to obtain better fastening. Even though the material of the soft cover is relatively flexible, the spine of the finished book, however, becomes rather rigid. Owing to the rigidity of the spine, the book opens poorly and is therefore difficult to read. If attempts are made to press the leaves of such an opened book more open, the spine of the book is readily broken, in which case the leaves tend to become loose and, in the worst case, the book is split into two parts.

The object of the present invention is to provide a soft-cover paperback book which eliminates the above drawbacks and which book can be opened easily despite the fact that the book is a paperback, soft-cover book.

This object is achieved by means of a book in accordance with the present invention, which is characterized in

- that a flexible, firm support layer is fastened to the back of the book block and
- that the soft cover is fastened to the book block only at the front and rear cover along a fastening stripe of glue positioned adjacent the spine edge of the first and and the last leaf of the book block respectively,
- so that the spine portion of the cover positioned between said fastening stripes is loose from the spine of the book block.

The invention is based on the idea that the spine of the soft cover is not at all fastened to the back of the book block, and that the spine of the cover is not used for joining the leaves of the block together. Instead, for joining the leaves of the book block together, a thin, highly flexible, firm support layer, such as a gauze, cloth or crepe strip or ribbon, fastened to the back of the book block is used, which flexible support layer does not substantially prevent opening of the book. Thus, in accordance with the invention, a more durable and more readily openable soft-cover paperback book is produced.

Another subject of the invention is a method of manufacturing such a book, and the method is characterized by

- fastening a flexible, firm support layer to the back of the book block by glueing,
- applying a glue stripe parallel to the back of the book block on the first and the last leaf of book block and

- fastening the soft cover at its front cover and rear cover by pressing onto said glue stripes.

The steps of manufacture of the book in accordance with the invention can be simply performed directly in a glue-binding machine.

The invention will be described below more closely with reference to the attached drawing, wherein FIG. 1 is a perspective view of a preferred embodiment of a book in accordance with the invention showing the book closed, FIG. 2 is a similar view showing the book opened, FIGS. 3 and 4 are enlarged perspective views of the spine portion of the book as opened and as closed, respectively, and FIG. 5 is a schematical view of an alternative embodiment of the book.

The book shown in FIGS. 1 to 4 of the drawings comprises a book block 2 consisting of numerous individual leaves 1 collected to form a bundle, i.e. simply placed loosely on top of each other. The leaves are joined together at their spine edges by means of a crepe strip 3, which is fastened to the book block by glueing by means of a glue layer 4, which is applied onto the entire surface of the back of the book block and partly onto the first leaf 1*a* and onto the last leaf 1*b* of the book block, as appears in particular from FIGS. 3 and 4.

In addition to the book block, the book comprises a cover 5, which is made of soft, flexible cardboard or paper. The cover comprises a front cover leaf 6, a rear cover leaf 7, and a spine 8. A crease 9 has been made at the connecting line between the spine and the front cover leaf and between the spine and rear cover leaf, respectively, and likewise a crease 10 has been made in the front cover leaf and in the rear cover leaf, said crease 10 being positioned at a distance from the first-mentioned crease 9.

A narrow glue stripe 11 has been applied onto the edge portions 3*a*, 3*b* of the crepe strip glued onto the book block, which edge portions extend onto the first and the last leaf of the book block, a distance from the back of the book block, which distance is substantially equal to the distance between the creases 9 and 10 in the cover. Said glue stripes fasten the cover to the book block, as appears from FIGS. 3 and 4.

For the glue layer 4 of the crepe strip, a cold glue and for the glue stripes 11 of the cover a hot-setting adhesive is favourably used.

It is to be noticed that, owing to the mode of binding described above, the cover is fastened to the book block only along the glue stripes 11. In a finished book, the spine 8 of the cover and the edge portions 6*a* and 7*a* next to the spine in the front cover leaf and rear cover leaf are thereby loose from the crepe fabric and from the book block. Thereby the spine of the soft cover does actually not participate in joining the leaves together, which is the case in soft-cover books so far known, but this function is performed by the crepe strip. Nevertheless, the spine of the cover still funtions as a part covering and protecting the back of the book block.

When the book is opened, the spine of the cover does not at all resist opening, because the spine 8 and the edge portions 6*a* and 7*a* of the front and rear cover leaves can move apart from the back of the book block, whereby the leaves of the book are opened readily and completely. Owing to the flexible crepe strip, the book block cannot be broken, nor can individual leaves become detached. FIG. 2 illustrates this situation.

FIG. 5 illustrates an alternative embodiment of the book, which differs from the above mainly only in the respect that the glue stripes 11 have been applied onto the edge portions 3*a* and 3*b* of the crepe strips up to the back of the book block and that a crease 9 has been made in the middle of the spine of the cover. When the book is opened, the spine of the cover is opened as V-shaped outwards, as is illustrated in FIG. 5.

The drawing and the related description are only intended to illustrate the idea of the invention. In its details, the book in accordance with the invention and the procedure of manufacture of the same may vary even considerably within the scope of the claims. Thus, the edge portions 3*a*, 3*b* of the crepe strip may be very narrow so that the glue stripes 11 are applied wholly or partly onto the first and the last leaf of the book block.

What I claim is:

1. A soft-cover paperback book, which comprises a block (2) consisting of leaves (1) joined together at their spine edges as well as a soft cover (5) fastened to said block, characterized in that a flexible, firm support layer (3) is fastened to the back of the book block (2) and that the soft cover (5) is fastened to the book block (2) only at the front and rear cover (6, 7) along a stripe (11) of glue positioned adjacent the spine edge of the first and the last leaf (1*a*, 1*b*) of the book block respectively, so that the spine portion (8) of the soft cover (5) positioned between said glue stripes (11) is loose from the spine of the book block.

2. A soft-cover book as claimed in claim 1 characterized in that the glue stripes (11) are positioned at a distance from the spine edge of the first and the last leaf (1*a*, 1*b*) of the book block (2).

3. A soft-cover book as claimed in claim 1, characterized in that the glue stripes (11) extend up to the spine edge of the first and the last leaf (1*a*, 1*b*) of the book block.

4. A soft-cover book as claimed in claim 2 or 3, characterized in that the support layer (3) fastened to the back of the book block (2) is at its edge portions (3*a*, 3*b*) fastened to the first and the least leaf (1*a*, 1*b*) of the book block.

5. A soft-cover book as claimed in claim 4, characterized in that the glue stripes (11) are positioned on the edge portions (3*a*, 3*b*) of the support layer (3).

6. A soft-cover book as claimed in claim 1, characterized in that the support layer (3) is a crepe strip.

7. A method of manufacturing a soft-cover paperback book, by joining a plurality of leaves (1) by means of glueing at their spine edges to form a book block (2) and fastening a soft cover (5) to said book block by means of glueing, characterized by fastening a flexible, firm support layer (3) to the back of the book block (2) by glueing, applying a glue stripe (11) parallel to the spine of the book block on the first and the last leaf (1*a*, 1*b*) of the book block (2), and fastening the soft cover (5) at its front cover (6) and rear cover (7) by pressing onto said glue stripes (11).

8. A method as claimed in claim 7, characterized in that said support layer (3) is glued onto the back of the book block (2) by means of a cold glue and the cover (5) is glued onto the book block by means of a hot-setting adhesive.

9. A method as claimed in claim 7 or 8, characterized in that said support layer (3) is at its edge portions (3*a*, 3*b*) fastened by means of glue stripes (11) onto the first leaf (1*a*) and the last leaf (1*b*) of the book block (2) and that said glue stripes (11) are applied onto said edge portions (1*a*, 1*b*) of the crepe strip.

10. A method as claimed in claim 9, characterized in that said glue stripes (11) are applied at a distance from the spine edge of the book block (2).

* * * * *